US006328542B1

(12) United States Patent
Serafin et al.

(10) Patent No.: US 6,328,542 B1
(45) Date of Patent: Dec. 11, 2001

(54) CHECK VALVE SYSTEM

(75) Inventors: Mark Serafin, Apple Valley; LeRoy C. Erickson, Blaine, both of MN (US)

(73) Assignee: Imation.Corp., Oakdale, MN (US)

( * ) Notice: Subject to any disclaimer, the term of this patent is extended or adjusted under 35 U.S.C. 154(b) by 0 days.

(21) Appl. No.: 09/363,400

(22) Filed: Jul. 29, 1999

(51) Int. Cl.[7] ..... F04B 17/00; F04B 35/00
(52) U.S. Cl. ..... 417/399; 417/225; 417/345
(58) Field of Search ..... 417/399, 225, 417/53, 345, 454, 364

(56) References Cited

U.S. PATENT DOCUMENTS

| | | | | |
|---|---|---|---|---|
| 2,819,835 | | 1/1958 | Newhall . | |
| 3,234,882 | | 2/1966 | Douglas et al. . | |
| 4,412,792 | * | 11/1983 | LaBorde et al. | 417/454 |
| 4,435,133 | * | 3/1984 | Meulendyk | 417/364 |
| 4,527,954 | | 7/1985 | Murali et al. . | |
| 4,533,254 | | 8/1985 | Cook et al. . | |
| 4,701,112 | * | 10/1987 | Eisenhut et al. | 417/345 |
| 5,241,986 | * | 9/1993 | Yie | 137/512 |
| 5,482,077 | | 1/1996 | Serafin . | |
| 5,507,624 | * | 4/1996 | Fehn | 417/53 |
| 5,852,076 | | 12/1998 | Serafin et al. . | |
| 5,865,029 | * | 2/1999 | Brieschke | 60/560 |
| 5,879,137 | * | 3/1999 | Yie | 417/225 |
| 6,135,069 | * | 10/2000 | Fenelon et al. | 123/46 R |

FOREIGN PATENT DOCUMENTS

| | | |
|---|---|---|
| 0 792 194 B1 | 9/1997 | (EP) . |
| WO 92/22748 | 12/1992 | (WO) . |

OTHER PUBLICATIONS

Huisman H.F., "Dispersion of (Magnetic) Pigment Powders in Organic Liquids," *Journal of Coatings Technology* 57(727): 49–56 (1985).

Winkler J. et al., "Theory for the Deagglomeration of Pigment Clusters in Dispersion Machinery by Mechanical Forces I," *Journal of Coatings Technology* 59(754): 35–41 (1987).

Winkler J. et al., "Theory for the Deagglomeration of Pigment Clusters in Dispersion Machinery by Mechanical Forces II," *Journal of Coatings Technology* 59(754): 45–53 (1987).

Winkler J. et al., "Theory for the Deagglomeration of Pigment Clusters in Dispersion Machinery by Mechanical Forces III," *Journal of Coatings Technology* 59(754): 55–60 (1987).

* cited by examiner

*Primary Examiner*—Teresa Walberg
*Assistant Examiner*—Thor Campbell
(74) *Attorney, Agent, or Firm*—Eric D. Levinson

(57) ABSTRACT

A check valve system and method control the opening and closure of a check valve that supplies product fluid to an intensifier pump based on the position of a piston within the intensifier pump. Position sensing allows anticipation of different events along the path traveled by the piston, such as the start and end of advance, retract, and precompression cycles. The system and method operate to selectively open and close associated check valves based on the sensed position to carefully control the delivery of fluid to each intensifier pump. Active control of the check valves based on piston position allows more precise timing of fluid delivery in relation to the piston cycles. Anticipation of the onset of piston advance and retraction cycles can improve valve response time, providing more uniform fluid pressure for a continuous, steady, high pressure flow of fluid with minimal pressure fluctuation.

23 Claims, 6 Drawing Sheets

CHECK VALVE SYSTEM

TECHNICAL FIELD

The present invention relates to valves and, more particularly, to check valve systems for use with intensifier pumps.

BACKGROUND INFORMATION

Hydraulic intensifier pumps are widely used in applications requiring the delivery of a high pressure jet of fluid. An intensifier pump includes a pump cylinder, a hydraulic working piston, a product intensifier piston, an inlet for the hydraulic working fluid, an inlet for the product fluid to be pressurized, and an outlet for the pressurized fluid. In operation, lower pressure hydraulic fluid is applied to the comparatively large working piston. The working piston, in turn, drives the smaller intensifier piston. The ratio of the hydraulic and product piston areas is the intensification ratio. The hydraulic pressure is multiplied by the intensification ratio to produce an increase in pressure.

The fluid to be intensified typically is delivered to the intensifier via an inlet check valve from a low pressure fluid supply pump. The fluid supply pump generally is able to generate sufficient pressure to overcome the tension of an internal poppet spring within the check valve, opening the check valve when the intensifier is in the retraction cycle and allowing product fluid to be delivered to the intensifier cylinder. When the piston begins its advance cycle to expel the pressurized fluid, the higher pressure of the intensified product fluid overcomes the lower supply pressure, closing the inlet check valve and thereby preventing backflow of the intensified fluid into the low pressure supply side of the pump. Many intensifier systems incorporate two or more single acting, single ended intensifier pumps, or two double intensifier pumps, that advance and retract on an alternating basis to provide a substantially continuous fluid jet. When one product intensifier piston retracts, the other advances. The relative timing of the advance and retraction cycles is carefully controlled to provide a substantially constant fluid pressure. Nevertheless, intensifier systems incorporating multiple single or double-acting intensifier pumps typically exhibit minor pressure fluctuations.

For industrial applications requiring precise fluid delivery, pressure fluctuation can be highly undesirable. For example, in processing of dispersions, emulsions, liposomes, and the like, the total amount of work, or energy, being applied is a function of both the mechanical power, or shear, and the time the product is in the shear zone. Further, in order to effectively process dispersions, the energy level must be sufficiently high and uniform to disperse agglomerate structure. A gradient of energy levels being applied to a dispersion, a result of processes having pulsation, will result in some of the product being subjected to insufficient processing. Continued processing of the product, under conditions where pulsations exist, cannot compensate for the gradient of energy levels that is less than the energy level required. Other applications that suffer from pulsation include the processing and pumping of coating solutions to a coating process such as a dual layer coating die.

SUMMARY

The present invention is directed to a high pressure check valve system useful with an intensifier pump. The check valve system is particularly useful in an intensifier pump system designed to be pulsation free, or "pipless." The check valve system includes a controller that controls the check valve based on the position of a piston within the intensifier pump barrel. The present invention also is directed to an intensifier pump system incorporating such a check valve system, as well as a method for controlling a check valve and an intensifier pump system based on the position of a piston within the intensifier pump barrel.

A system and method, in accordance with the present invention, preferably senses a continuous position of one or more intensifier pistons during operation. The term "continuous position," as used herein, means the position of a hydraulic working piston or product intensifier piston at one of several points along the path traveled by the piston, in contrast to sensing merely a single termination or proximity point, e.g., at the end of a cycle. Continuous position sensing allows anticipation of different events along the path traveled by the piston, such as the start or end of a cycle. In some embodiments, however, use of a proximity sensor may be acceptable.

The position of the product intensifier piston may be sensed directly. Alternatively, the position of the hydraulic working position may be sensed as an indication of the position of the product intensifier piston. In other words, the position of the hydraulic working piston will provide an indirect indication of the position of the product intensifier piston. The system and method operate to selectively open and close associated inlet check valves based on the sensed position to carefully control the delivery of product fluid to each intensifier pump. Active control of the check valves based on continuous piston position allows more precise timing of fluid delivery in relation to advance, retraction, and preload stages of the piston cycle. Anticipation of the onset of piston advance and retraction cycles can improve valve response time, providing an actively controlled "smart" valve. Valve operation can be made more efficient, and can be tuned according to the characteristics of the valve and the product fluid.

With this check valve system and method, the operation of an intensifier pump can provide more uniform fluid pressure. For example, check valves associated with multiple single acting and double acting intensifier pumps can be coordinated to provide a continuous, steady, high pressure flow of product fluid with minimal pressure fluctuation. In addition, the check valves can be actively controlled with an actuator to provide increased initial closing force, increased seating pressures, and increased opening and closing speeds. Also, in some embodiments, actuation speed can be dynamically controlled by controlling the characteristics of the valve actuator. The result is a check valve having an accelerated response time, allowing precise synchronization with the intensifier piston.

With improved response time, the inlet check valve can be opened more quickly to increase the amount of fluid pumped to the intensifier cylinder during the retract cycle. In addition, the check valve can be closed more quickly, minimizing valve leakage upon initiation of the advance cycle of the intensifier piston. The inlet check valve can be particularly useful for applications involving the delivery of pigmented dispersions having higher viscosity levels or particulate structures. Active control based on continuous piston position permits the system to compensate for changes in the characteristics of the product being processed through the inlet check valves.

Knowledge of the continuous position of the product intensifier piston enables anticipation of an event such as, for example, the end of the advance cycle or the start of the retract cycle. This anticipation advantage allows check valve actuation to be finetuned according to intensifier pump operation. Also, negative effects on valve hysteresis resulting from product fluid characteristics such as high viscosities and particulate structures can be compensated by tuning check valve actuation. With relatively large opening and closing forces and active actuation, the valve system is able to function positively when encountering high viscosity dispersions having a wide particle size distribution, and need not be subject to a fixed spring bias response.

In one embodiment, the present invention provides a system for controlling the flow of fluid to an intensifier pump, the system comprising a check valve housing defining an inlet for communication with a fluid supply, an outlet for communication with the intensifier pump, and a fluid flow channel extending between the inlet and the outlet, a valve poppet that is movable within the fluid flow channel to open and close the flow channel, thereby controlling the flow of fluid to the intensifier pump, an actuator that moves the valve poppet within the fluid flow channel, a position sensor that senses a position of a piston within the intensifier pump, and a controller that controls the actuator to move the valve poppet based on the sensed position of the piston within the intensifier pump.

In another embodiment, the present invention provides an intensifier pump system comprising a first intensifier pump having a first piston, a first fluid inlet, and a first fluid outlet, a second intensifier pump having a second piston, a second fluid inlet, and a second fluid outlet, wherein the first and second outlets feed a common fluid flow line, a first check valve that controls the flow of fluid into the first fluid inlet, a second check valve that controls the flow of fluid into the second fluid inlet, a first position sensor that senses a position of the first piston within the first intensifier pump, a second position sensor that senses a position of the second piston within the second intensifier pump, and a controller that controls the first and second check valves based on the sensed positions of the first and second pistons.

In a further embodiment, the present invention provides a system for controlling the flow of fluid to an intensifier pump, the system comprising a check valve defining an inlet for communication with a fluid supply, an outlet for communication with the intensifier pump, and a fluid flow channel extending between the inlet and the outlet, a position sensor that senses a position of a piston within the intensifier pump, and a controller that opens and closes the check valve based on the sensed position of the piston within the intensifier pump.

In an added embodiment, the present invention provides a method for controlling the flow of fluid from a fluid supply to an intensifier pump via a check valve, the method comprising sensing a position of a piston within the intensifier pump, and controlling the check salve to selectively open and close based on the sensed position of the piston within the intensifier pump.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Figure 1:
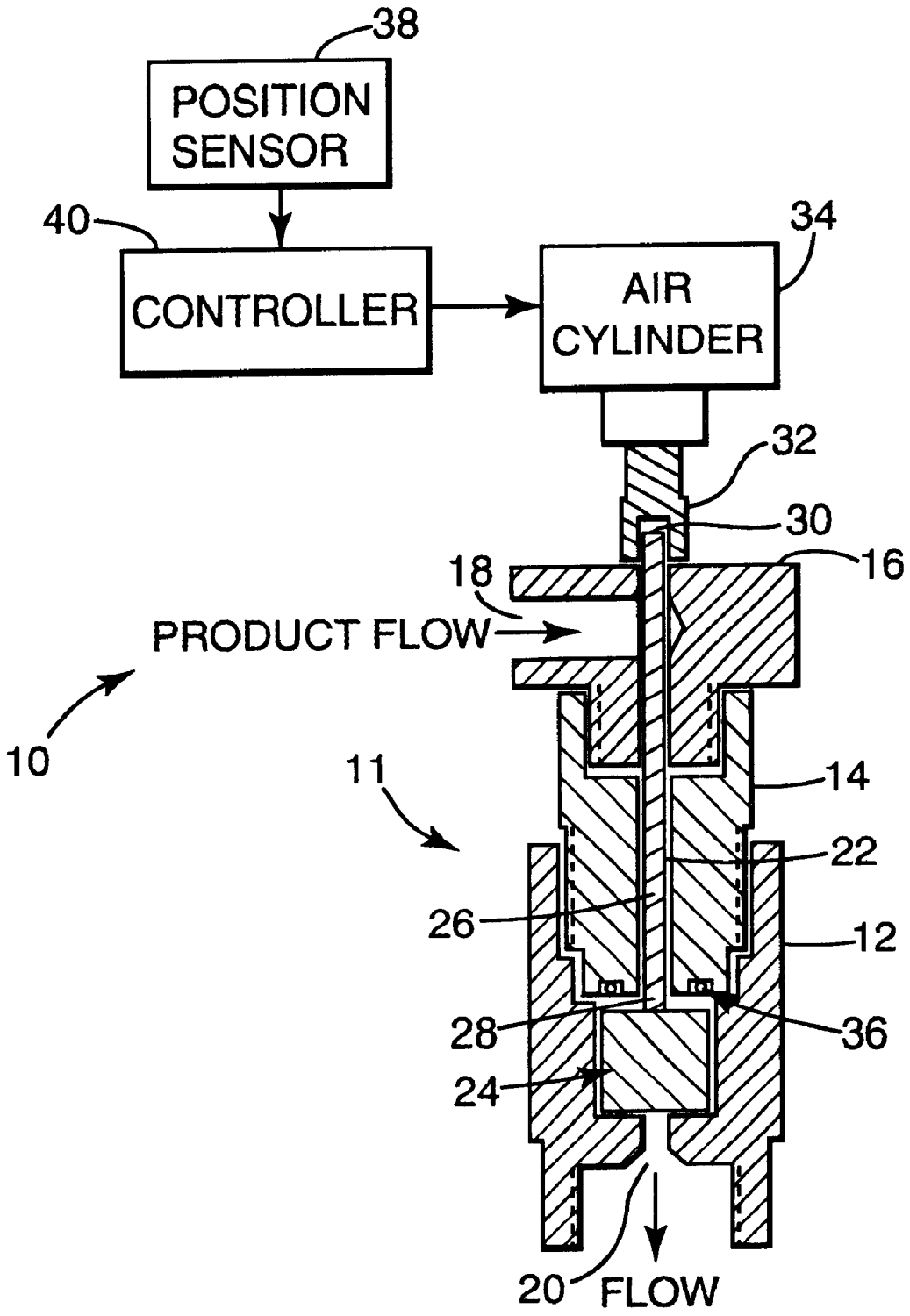
FIG. 1 is a diagram of a high pressure check valve system.

FIG. 1 is a diagram of a high pressure check valve system 10 in accordance with an embodiment of the present invention. Valve system 10 may be particularly useful in the delivery of continuous, steady, high pressure flow of pigmented dispersions via an intensifier pump, where avoidance of significant pressure fluctuation is desirable. An example application is the delivery of coating compositions for manufacture of magnetic data storage media. In such an application, an intensifier pump may be used to deliver pigmented dispersions having abrasive materials with particles that range from submicron sizes to sizes that exceed those captured by a 60 mesh screen, at throughputs exceeding 2 gpm, and for periods of time exceeding 100 hours of operation. Typical fluid pressure may range from 0 psi to 40,000 psi, or greater, during each intensifier cycle.

As shown in FIG. 1, check valve system 10 includes a check valve 11 with a housing that includes a valve body 12, a valve seat nut 14, and a valve adapter 16. Valve adapter 16 defines an inlet 18 for communication with a product fluid supply. Valve body 12 defines an outlet 20 for communication with an intensifier pump or other fluid destination. Valve body 12, valve seat nut 14, and valve adapter 16 together define a fluid flow channel 22 that extends between inlet 18 and outlet 20. Check valve 11 further includes a valve poppet 24 that is movable within fluid flow channel 22 to open and close the flow channel, thereby controlling the flow of fluid from inlet 18 to outlet 20. The structure of valve body 12, including poppet 24, may conform substantially to that of a valve disclosed in U.S. Pat. No. 5,482,077 to Serafin. Valve 11 need not incorporate a spring bias, however, for activation of poppet 24.

An actuator 26 moves valve poppet 24 within fluid flow channel 22. Actuator 26 may take the form of a shaft-like member having one end 28 that is coupled to an inlet side of poppet 24. The opposite end 30 of actuator 26 is coupled to a piston 32 that is mounted in an air cylinder 34. In operation, air cylinder 34 is controlled to selectively move actuator 26 up and down within flow channel 22. Air cylinder 34 can be coupled to a pneumatic supply via one or more valves. One or more pneumatic solenoids associated with air cylinder 34 are actuated to open and close the valves, and thereby selectively actuate the actuator 26. Piston 32 retracts and extends relative to air cylinder 34 to drive actuator 26. In turn, actuator 26 moves poppet 24 up and down, sealing and unsealing the poppet against a valve seat o-ring 36, to thereby open and close valve 11. With actuator 26, valve 11 does not require a spring to bias poppet 24 in a desired position. Instead, air cylinder 34 and piston 32 actively control the position of poppet 24.

With further reference to FIG. 1, when check valve 11 is used to control product fluid delivery to an intensifier pump, a position sensor 38 preferably senses the continuous position of a piston within the intensifier pump. Monitoring of continuous piston position allows anticipation of the onset of piston advance and retraction cycles, improving response time of valve 11. Based on the sensed position of the piston, a controller 40 controls actuator 26 to move valve poppet 24. In particular, controller 40 controls air cylinder 34 to move piston 32 and thereby open and close valve 11. In this manner, the operation of check valve 11 is actively controlled. The delivery of fluid to the intensifier pump can be controlled on a closed-loop basis in synchronization with the pumping cycle of the pump. As a result, check valve 11 can provide precise control of fluid delivery to the intensifier pump. In some embodiments, use of a proximity sensor may be acceptable.

A check valve 11 as shown in FIG. 1 provides a number of advantages. As a first example, active control and actuation of valve 11 via air cylinder 34 can provide the valve with increased initial closing force. Initial seating pressures of 400 to 700 psi at o-ring 36 can be readily achieved. To facilitate increased seating pressures, the area ratio between air cylinder 34 and o-ring 36 can be increased. Second, active control of valve 11 can increase the opening and closing speeds of the valve, relative to passive, spring-loaded valves. Third, actuation speed can be dynamically controlled by remotely adjusting the volume of air delivered to air cylinder 34. Fourth, actuation speed can be further increased by selection of the pneumatic solenoid used to deliver air to air cylinder 34. Specifically, a pneumatic solenoid with an increased actuation speed will likewise increase the actuation speed of air cylinder 34 and valve 11.

Figure 2A:
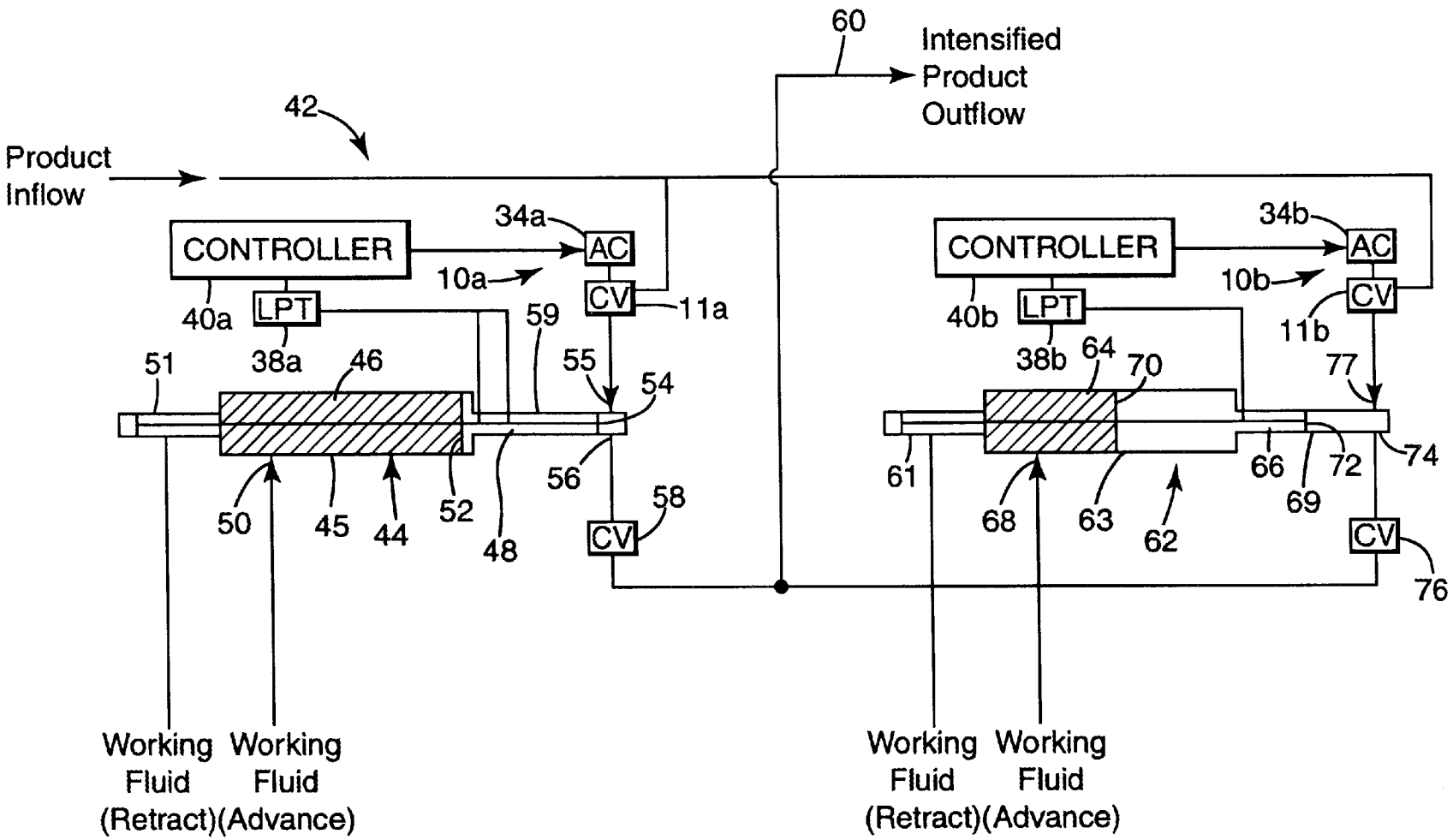
FIG. 2*a* is a is a conceptual diagram of an intensifier pump system incorporating a check valve system as shown in FIG. 1 and a linear position transmitter (LPT) arrangement for piston position sensing.

FIG. 2*a* is a conceptual diagram of an intensifier pump system 42 incorporating a pair of high pressure check valve systems 10 as shown in FIG. 1. A check valve system 10 may be used in a system incorporating a single product intensifier piston. Multiple check valves and intensifier pistons can be coordinated, however, to provide substantially continuous high pressure flow in duplex or multiplex intensifier systems. With reference to FIG. 2*a,* system 42 includes a first intensifier 44 having a hydraulic cylinder 45 with a hydraulic working section 46 and a product intensifier barrel 48. Intensifier barrel 48 has a significantly smaller diameter than that of working section 46, promoting increased fluid pressure within the intensifier barrel. Working fluid delivered via an inlet 50 drives a working piston 52 along working section 46. Working piston 52, in turn, drives product intensifier piston 54 along intensifier barrel 48. Intensifier barrel 48 receives product fluid via an inlet 55 and a check valve system 10*a.* Intensifier piston 54 expels product fluid from an outlet 56 and through a check valve 58 for delivery to a product outflow line 60.

As further shown in FIG. 2*a,* system 42 includes a second intensifier 62 that conforms substantially to first intensifier 44. In particular, second intensifier 62 has an intensifier cylinder 63 that includes a hydraulic working section 64 and product intensifier barrel 66. Intensifiers 44, 62 further include retraction intensifiers 51, 61, respectively. Working fluid delivered via an inlet 68 drives a hydraulic working piston 70 along working section 64. Working piston 70 drives intensifier piston 72 along intensifier barrel 66 and within intensifier barrel 66. Intensifier piston 72 expels fluid from an outlet 74 and through a check valve 76 for delivery to product outflow line 60. Intensifier barrel 66 receives product fluid via an inlet 77 and check valve system 10*b*. The advance and retract cycles of intensifiers 44, 62 are controlled by the delivery of hydraulic working fluid to hydraulic working barrels 46, 64, respectively. Coordinated control of duplex intensifiers is well known in the art.

The operation of intensifiers 44, 62 is offset such that one intensifier advances under the force of hydraulic working fluid to deliver product fluid to outflow line 60 while the other retracts to fill with hydraulic working fluid and product fluid. Thus, intensifiers 44, 62 work in tandem to provide a substantially continuous flow of product fluid to product outflow line 60. Check valve systems 10*a,* 10*b* ensure the delivery of product fluid to intensifier barrels 48, 66, respectively, in manner that promotes a substantially continuous flow of product fluid in product outflow line 60 and minimizes pressure fluctuations. As described with reference to FIG. 1, each check valve system 10*a,* 10*b* includes, respectively, a check valve 11*a,* 11*b* an air cylinder 34*a,* 34*b,* a position sensor 38*a,* 38*b,* and a controller 40*a,* 40*b.*

In the embodiment of FIG. 2*a,* each position sensor 38*a,* 38*b* takes the form of a linear position transducer (LPT) that provides a continuous, accurate position of product pistons 54, 72 during the entire length of the piston cycle, allowing anticipation of the start or end of a particular cycle. Each LPT 38*a,* 38*b,* as is well known, may include a rod that is physically coupled to a working piston 52, 70 or a product piston 54, 72, respectively. Movement of the rod in response to movement of the respective piston is transduced by a potentiometer associated with LPT 38*a,* 38*b* to indicate the position of product piston 54, 72, respectively. Each LPT 38*a,* 38*b* transmits a signal providing a voltage, current, or frequency that indicates the position to controllers 40*a,* 40*b,* respectively. In some applications, the signal transmitted by LPT 38*a,* 38*b* can be digitally encoded.

Figure 2B:
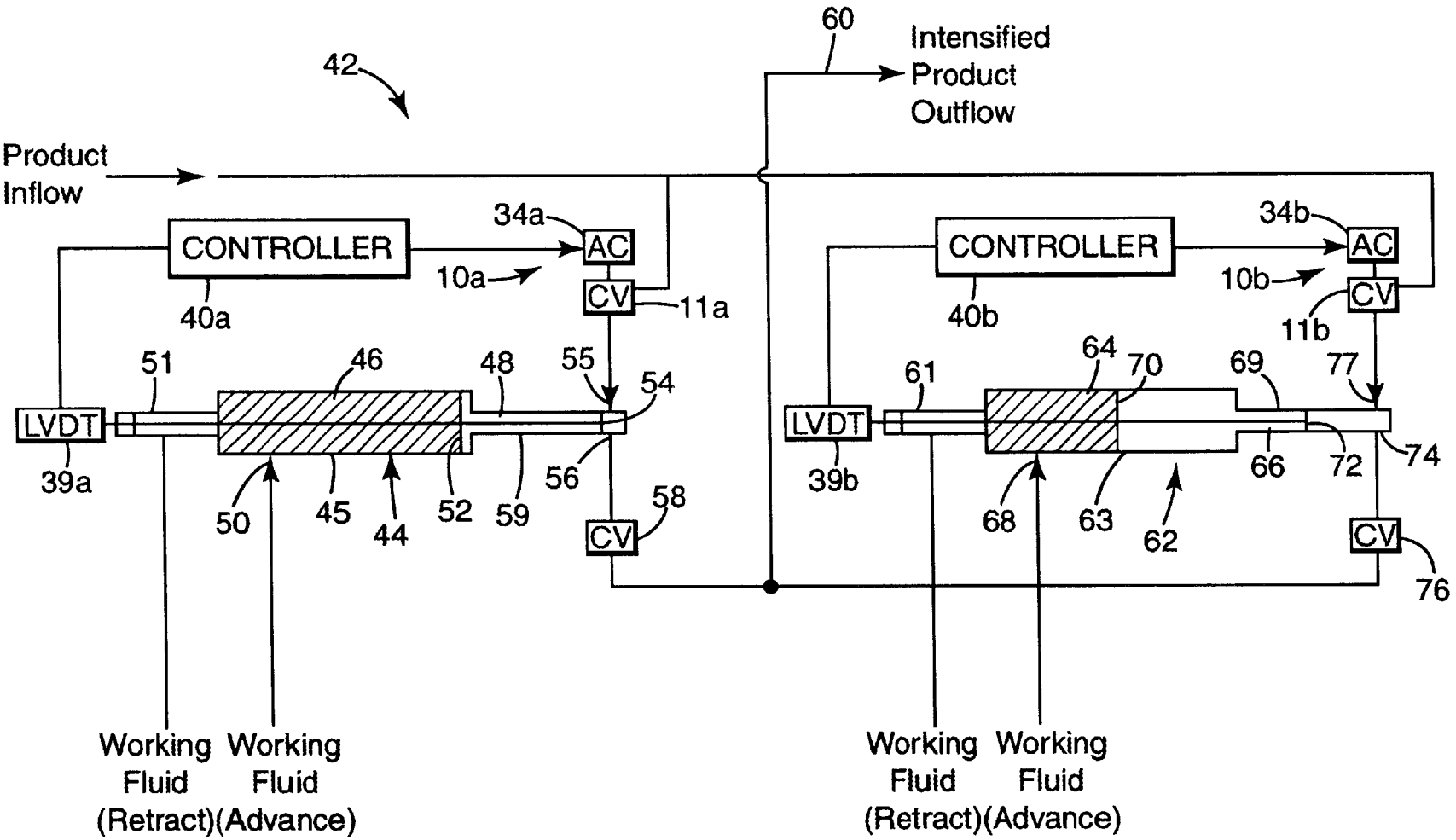
FIG. 2*b* is a conceptual diagram of another intensifier pump system incorporating a check valve system as shown in FIG. 1 and a linear variable displacement transducer (LVDT) for piston position sensing.

As an alternative, the position sensors can be realized by linear variable displacement transducers (LVDT). FIG. 2*b* illustrates the use of LVDT's 39*a,* 39*b* in a system as shown in FIG. 2*a*. An LVDT requires no physical connection to pistons 52, 70 or 54, 72. Instead, as is well known, the LVDT operates to sense position electromagnetically by reference to piston 52, 70 or 54, 72 or a component carried by the respective piston. In particular, the LVDT may include a core mounted on or within hydraulic piston 46, 64 and a coil mounted about the piston. Like the LPT, the LVDT produces a signal that varies with linear displacement of the respective piston. The signal can be digitally encoded, if desired. LPT and LVDT sensors are described herein for purposes of example and not limitation. Accordingly, other position sensors can be used to ascertain piston position. With either an LPT or LVDT, the sensed position provides an indication, directly or indirectly, of the continuous position of product pistons 54, 72, thereby allowing synchronization of check valves 11*a,* 11*b* with the product pistons to deliver fluid to intensifier barrels 48, 66.

Also, such sensors may sense the position of either hydraulic working pistons 52, 70 or product intensifier pistons 54, 72. Working pistons 52, 70 move together with intensifier pistons 54, 72, respectively. Hence, the position of a working piston 52, 70 is indicative of the product intensifier piston 54, 72, respectively. For an LPT, it may be most convenient to provide a physical connection to product pistons 54, 72. With an LVDT, however, electromagnetic interaction with working pistons 52, 70 or product pistons 54, 72 can be readily achieved. In either case, the sensed position provides an indication, directly or indirectly, of the continuous position of product pistons 54, 72, allowing synchronization of the check valves 11*a,* 11*b* with the product pistons to deliver product fluid to intensifier barrels 48, 66.

Controllers 40*a,* 40*b* drive air cylinders 34*a,* 34*b,* respectively, to actuate check valves 11*a,* 11*b,* and control delivery of product fluid to intensifier barrels 48, 66. Each controller 40*a,* 40*b* may take the form of a programmable processor, microcontroller, or ASIC arranged to control check valves 11*a,* 11*b.* If embodied as a processor, each controller 40*a,* 40*b* may reside on a general purpose computer with a single- or multi-chip microprocessor such as a Pentium® processor, a Pentium Pro® processor, an 8051 processor, a MIPS processor, a Power PC® processor, or an Alpha® processor. Alternatively, the processor may take the form of any conventional special purpose microprocessor. As a further alternative, controller 40*a,* 40*b* can be realized by discrete circuitry that processes position signals generated by position sensors 38*a,* 38*b,* or 39*a,* 39*b,* to generate control signals that drive air cylinders 34*a,* 34*b* to open and close check valves 11*a,* 11*b.* Thus, in contrast to microprocessor embodiments, controllers 40*a,* 40*b* could be realized by simple circuitry embodiments that compare the position signals to reference levels.

Controllers 40*a,* 40*b,* although represented separately in FIGS. 2*a* and 2*b,* can be realized by a single controller that operates in response to position signals from position sensors 38*a,* 38*b* to control both check valve 11*a* and check valve 11*b.* In a processor embodiment, program code executed by controllers 40*a,* 40*b* is arranged to drive air cylinders 34*a,* 34*b* in a coordinated mode such that product fluid is fed to duplex intensifiers 44, 62 in an alternating fashion that is synchronized with the advance and retract cycles of pistons 54, 72. By sensing the continuous position of working pistons 52, 70 or intensifier pistons 54, 72 via position sensors 38*a,* 38*b* , controllers 40*a,* 40*b* are capable of anticipating advance and retract cycles, and thereby optimizing the opening and closing of check valves 11*a,* 11*b* to maximize product fluid volumes on the retract cycle and minimize leakage and backflow on the advance cycle.

Figure 3:
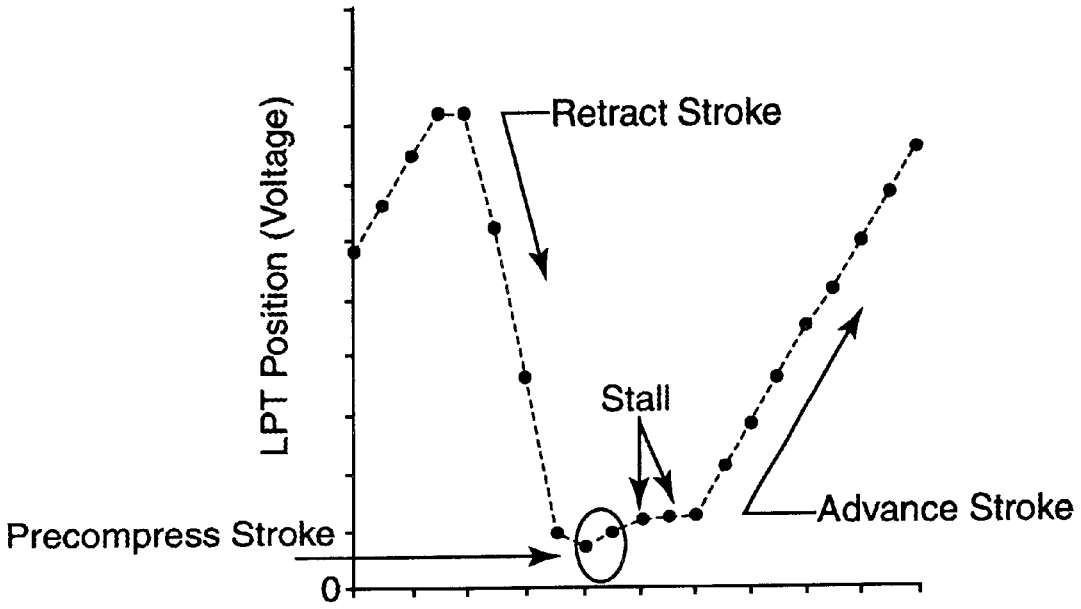
FIG. 3 is a graph illustrating operation of an intensifier pump in a system as shown in FIGS. 2*a* and 2*b;*

FIG. 3 is a graph illustrating operation of an intensifier pump in a system as shown in FIGS. 2*a* and 2*b.* The graph of FIG. 3 plots time on the X axis versus position, as indicated by LPT voltage, on the Y axis. With reference to intensifier 62, intensifier product piston 72 undertakes a retract cycle in which intensifier barrel 66 fills with product fluid. In the retract cycle, the product fluid is pumped via a low pressure supply pump through check valve 11*a* and inlet 77. At the same time, hydraulic fluid is pumped into retraction intensifier 61, thereby purging hydraulic cylinder 63 of hydraulic working fluid. Intensifier piston 72 then enters a precompression cycle and a stall stage prior to beginning an advance cycle. During the advance cycle, hydraulic cylinder 64 fills with working fluid, moving hydraulic piston 70 and product piston 72. In the advance cycle, product piston 54 expels product fluid from intensifier barrel 66.

Figure 4:
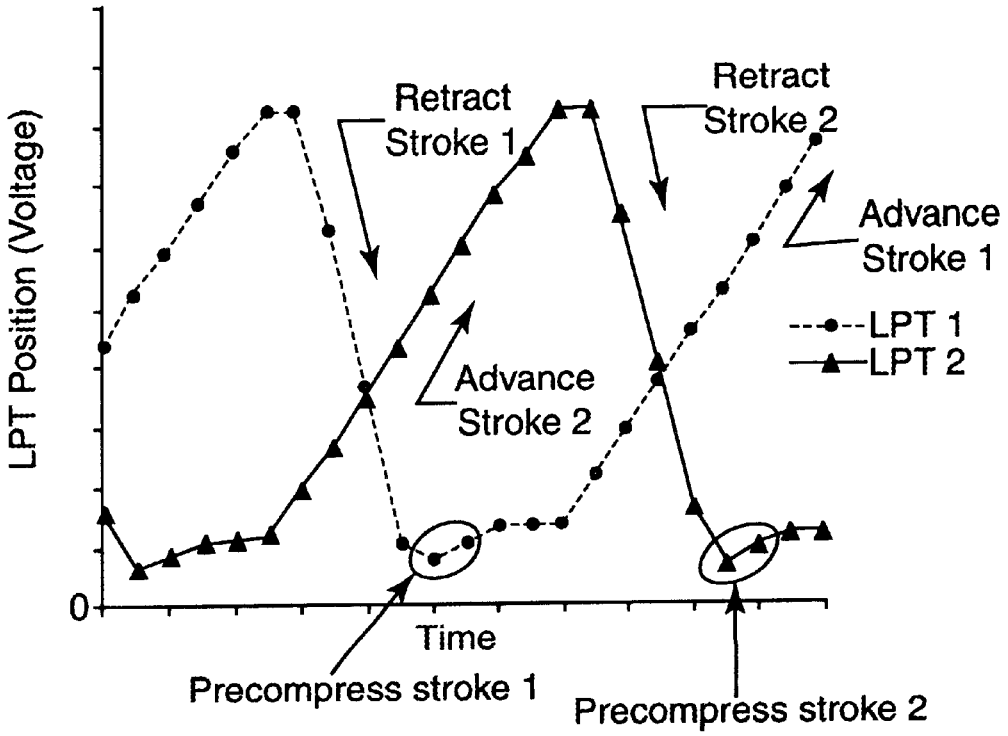
FIG. 4 is graph illustrating operation of complementary intensifier pumps in a system as shown in FIGS. 2*a* and 2*b;*

FIG. 4 is a graph illustrating operation of complementary intensifiers 44, 62 operating in a duplex mode in a system as shown in FIGS. 2*a* and 2*b.* As shown in FIG. 4, intensifiers 44, 62 operate in an alternating manner such that one intensifier expels product fluid while the other takes in product fluid. Thus, the advance and retract cycles of intensifiers 44, 62 temporally overlap. In this manner, intensifiers 44, 62 together feed a substantially continuous flow of product fluid to outlet line 60. The relative timing of intensifiers 44, 62 can be controlled by a system that modulates the delivery of working fluid via inlets 50, 68. Such systems are well known in the art. Check valves 11*a,* 11*b,* in accordance with the present invention, are controlled in synchronization with the movement of product intensifier pistons 54, 72.

With further reference to FIG. 4, each intensifier 44, 62 has a cycle that includes the retract cycle, precompression cycle, and advance cycle. During the retract cycle for intensifier 44, intensifier barrel 48 of intensifier 44 fills with product fluid. The next cycle, occurring at the start of the advance cycle, is the precompression cycle. During the precompression cycle, product fluid within intensifier barrel 48 is pumped, via intensifier product piston 54, ramping up pressure until the pressure level is almost at the same level as that of the second intensifier 62. At this point, product intensifier pistons 54, 72 are at almost the same pressure level. Consequently, product intensifier piston 54 effectively stops until the second intensifier piston 72 completes its advance cycle. Thus, intensifier piston 54 enters a momentary stall cycle. The final portion of the cycle is the advance cycle, in which the pressure of intensifier piston 54 exceeds that of intensifier piston 72. Intensifier product piston 54 then expels the product fluid from intensifier barrel 48.

Figure 5:
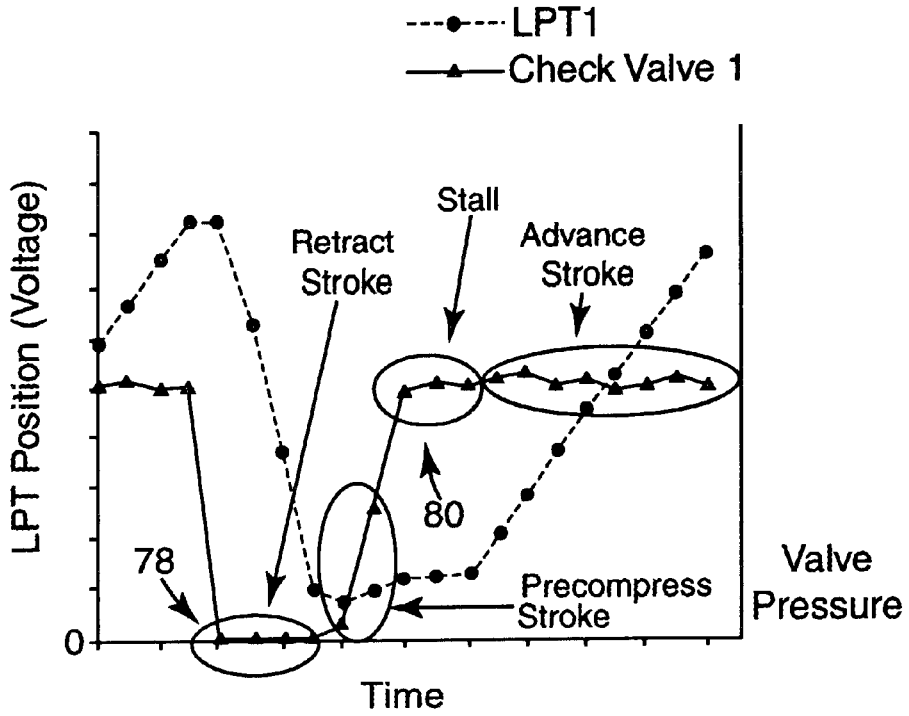
FIG. 5 is a graph illustrating operation of a check valve system as shown in FIG. 1.

FIG. 5 is a graph illustrating operation of a check valve 11*a* as shown in FIGS. 2*a* and 2*b* relative to the operation of an intensifier 44. The operation of intensifier 44 is illustrated in terms of an LPT voltage indicating the position of pistons 52, 70. The operation of check valve 11*a* is illustrated in terms of check valve pressure. As shown in FIG. 5, check valve 11*a* is actuated to deliver product fluid to the intensifier barrel 48 based on the continuous position signal provided by position sensor 38*a.* When the LPT signal indicates that the intensifier 44 is starting the retraction cycle, valve 11*a* is opened, as indicated by reference numeral 78, allowing delivery of product fluid to fill intensifier barrel 48. When the LPT signal indicates that intensifier 44 is ending the retraction cycle and entering the precompress cycle, valve 11*a* is closed as indicated by reference numeral 80, terminating delivery of product fluid and preventing backflow of intensified fluid when the intensifier begins the advance cycle.

Again, the actuation of check valve 11*a* can be actively controlled based on the continuous position of product intensifier piston 54, which is indicative of the intensifier piston cycle. In particular, the continuous position signal allows anticipation of an event, such as the advance cycle. This allows check valve 11*a* to be closed, for example, prior to the onset of the advance cycle. In this manner, active control of check valve 11*a* enables optimal filling of intensifier barrel 48 with product fluid during the retract cycle, and prevents fluid leakage and backflow during the advance cycle. Active control of check valve 11*a* also can provide enhanced response time and seating pressure. Such advantages make check valve system 10 especially useful with high viscosity dispersions having particulate structures and wide particle size distribution. In particular, check valve system 10 can be tuned to compensate for valve hysteresis resulting from product fluid variations.

Notably, an increased response time in opening check valve 11*a* can actually reduce the duration of the precompress cycle. When valve 11*a* is opened earlier in the retract cycle, the valve stays open longer. As a result, intensifier barrel 48 is able to take on a greater volume of product fluid. With a greater volume of product fluid, product intensifier barrel 48 is able to achieve target pressure more quickly in the precompress cycle. This results in a shorter time duration for the precompress cycle and a longer stall cycle. With more time allowed for product fluid to be pumped into product intensifier barrel 48, a greater volume of product fluid is provided. A full intensifier barrel 48 is able to develop product pressure in less time than an intensifier barrel that is less full.

Figure 6:
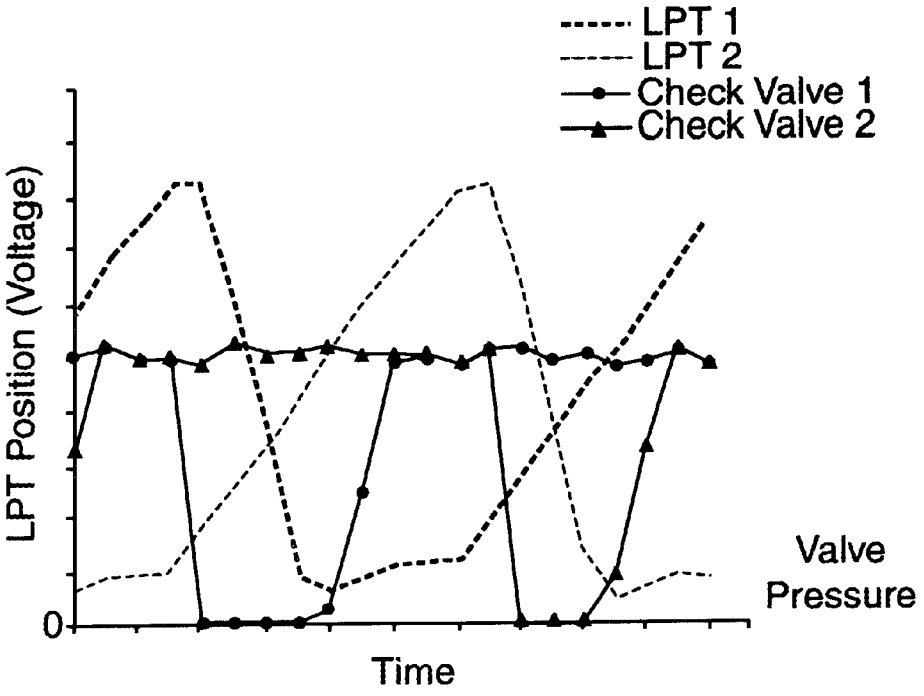
FIG. 6 is a graph illustrating operation of check valve systems as shown in FIG. 1 in conjunction with complementary intensifier pumps as shown in FIGS. 2*a* and 2*b.

FIG. 6 is a graph illustrating operation of check valves 11*a,* 11*b* as shown in FIGS. 2*a* and 2*b* in conjunction with duplex intensifiers 44, 62 as shown in FIG. 2. Like FIG. 5, FIG. 6 illustrates intensifier operation in terms of intensifier piston position and check valve operation in terms of valve pressure. As illustrated by FIG. 6, check valves 11*a,* 11*b* operate in an alternating manner, opening and closing in response to the sensed position of the respective working piston 52, 70. Notably, system 42 is scalable such that multiple check valve systems 10 could be employed with multiple intensifiers. For example, check valve systems 10 could be applied to intensifier systems having three, four, or more intensifiers to optimize product fluid volumes and minimize leakage and backflow among the alternating intensifiers. Accordingly, application of check valve system 10 is not limited to intensifier systems having only one or two intensifiers.

Figure 7:
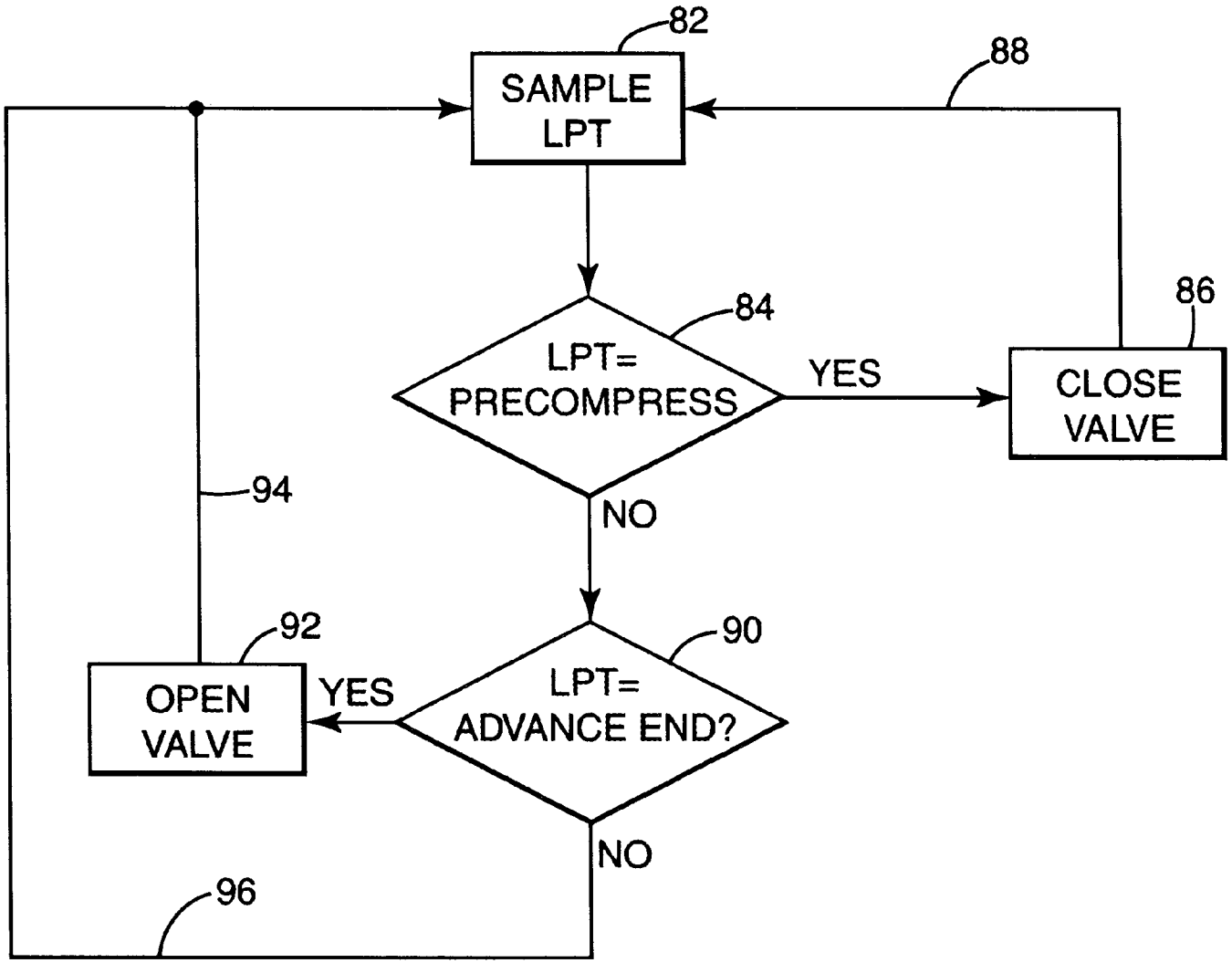
* and FIG. 7 is a flow diagram illustrating operation of a check valve system as shown in FIG. 1.

FIG. 7 is a flow diagram illustrating operation of a check valve 11*a* as shown in FIGS. 2*a* and 2*b*. The flow diagram of FIG. 7 illustrates control of the actuation of check valve 11*a* based on the sensed position of product intensifier piston 54 as an indication of intensifier cycle position. In operation, controller 40*a* continuously samples the LPT signal generated by position sensor 38*a,* as indicated by block 82, to obtain a continuous indication of the position of product piston 54. If the LPT signal indicates that product piston 54 entered the precompress cycle and is in a stall condition, as indicated by block 84, controller 40*a* drives air cylinder 34*a* to close valve 11*a* in anticipation of the advance cycle, as indicated by block 86. Thus, valve 11*a* terminates delivery of product fluid to intensifier barrel 48 and closes to prevent leakage and backflow.

Meanwhile, controller 40*a* continues to sample the LPT signal, as indicated by loop 88 and block 82. In the event the LPT signal generated by position sensor 38*a* does not indicate the precompress condition, controller 40*a* determines whether the product intensifier piston 54 has reached the end of the advance cycle, as indicated by block 90. Valve 11*a* remains closed until the end of the advance cycle. When the LPT signal indicates that the product intensifier piston 54 has completed the advance cycle and is about to enter the retraction cycle, controller 40*a* activates air cylinder 34*a* to open valve 11*a,* as indicated by block 92, and allow product fluid to flow into intensifier barrel 54. Then, controller 40*a* continues to sample the LPT signal as indicated by loop 94 and block 82. If the advance cycle is not complete, controller 40*a* continues to sample the LPT signal, as indicated by loop 96 and block 82. This routine is generally continuous and operates in an alternating manner with valve system 10*b*.

A number of embodiments of the present invention have been described. Nevertheless, it will be understood that various modifications may be made without departing from the spirit and scope of the invention. Accordingly, other embodiments are within the scope of the following claims.

What is claimed is:

1. A system for controlling the flow of fluid to an intensifier pump, the system comprising:

a check valve housing defining an inlet for communication with a fluid supply, an outlet for communication with the intensifier pump, and a fluid flow channel extending between the inlet and the outlet;

a valve poppet that is movable within the fluid flow channel to open and close the flow channel, thereby controlling the flow of fluid to the intensifier pump;

an actuator that moves the valve poppet within the fluid flow channel;

a position sensor that senses a position of a piston within the intensifier pump; and a controller that controls the actuator to move the valve poppet based on the sensed position of the piston within the intensifier pump.

2. The system of claim 1, wherein the position sensor provides a substantially continuous indication of the position of the piston along a path traveled by the piston within the pump.

3. The system of claim 1, wherein the position sensor comprises a linear position transducer that physically interacts with the piston to sense the position of the piston.

4. The system of claim 1, wherein the position sensor comprises a linear variable displacement transducer that electromagnetically interacts with the piston to sense the position of the piston.

5. The system of claim 1, wherein the actuator includes a shaft having a first end coupled to the valve poppet and a second end disposed within an air cylinder, wherein the air cylinder includes one or more valves, and the controller includes one or more solenoids that open and close the valves to selectively actuate the shaft and the poppet.

6. The system of claim 1, wherein the controller is programmed to drive the actuator and the valve poppet to open the outlet when the sensed position of the piston indicates that the piston is in a retraction cycle.

7. The system of claim 1, wherein the controller is programmed to drive the actuator and the valve poppet to close the outlet when the sensed position of the piston indicates that the piston is in an advance cycle.

8. The system of claim 1, wherein the position sensor senses the position of a product intensifier piston within the intensifier pump.

9. An intensifier pump system comprising:

a first intensifier pump having a first piston, a first fluid inlet, and a first fluid outlet;

a second intensifier pump having a second piston, a second fluid inlet, and a second fluid outlet, wherein the first and second outlets feed a common fluid flow line;

a first check valve that controls the flow of fluid into the first fluid inlet;

a second check valve that controls the flow of fluid into the second fluid inlet;

a first position sensor that senses a position of the first piston within the first intensifier pump;

a second position sensor that senses a position of the second piston within the second intensifier pump; and a controller that controls the first and second check valves based on the sensed positions of the first and second pistons.

10. The system of claim 9, further comprising a pump controller that controls the advance, retraction, and preload cycles of the first and second intensifier pumps.

11. The system of claim 9, wherein each of the first and second position sensors provides a substantially continuous indication of the position of the respective first and second piston within the pump.

12. The system of claim 9, wherein each of the first and second position sensors comprises a linear position transducer physically interacts with the respective first and second piston to sense the position.

13. The system of claim 9, wherein each of the first and second position sensors comprises a linear variable displacement transducer that electromagnetically interacts with the respective first and second piston to sense the position.

14. The system of claim 9, wherein the controller includes a first actuator that opens and closes the first check valve and a second actuator that opens and closes the second check valve, wherein each of the first and second check valves includes a valve poppet that is movable to selectively permit and obstruct fluid flow, and each of the first and second actuators includes a shaft having a first end coupled to the respective valve poppet and a second end disposed within an air cylinder, wherein the air cylinder includes one or more valves, and the valve controller includes one or more solenoids that open and close the valves to selectively actuate the valve poppet.

15. The system of claim 9, wherein the controller is programmed to open the first check valve when the sensed position of the first piston indicates that the first piston is in a retraction cycle, and open the second check valve when the sensed position of the second piston indicates that the second piston is in a retraction cycle.

16. The system of claim 9, wherein the controller is programmed to close the first check valve when the sensed position of the first piston indicates that the first piston is in an advance cycle, and close the second check valve when the sensed position of the second piston indicates that the second piston is in an advance cycle.

17. The system of claim 9, wherein the controller comprises a first controller that controls the first valve and a second controller that controls the second valve.

18. A system for controlling the flow of fluid to an intensifier pump, the system comprising:

a check valve defining an inlet for communication with a fluid supply, an outlet for communication with the intensifier pump, and a fluid flow channel extending between the inlet and the outlet;

a position sensor that senses a position of a piston within the intensifier pump; and a controller that opens and closes the check valve based on the sensed position of the piston within the intensifier pump.

19. The system of claim 18, wherein the position sensor provides a substantially continuous indication of the position of the piston along a path traveled by the piston within the pump.

20. The system of claim 18, wherein the position sensor comprises a linear position transducer that physically interacts with the piston to sense the position of the piston.

21. The system of claim 18, wherein the position sensor comprises a linear variable displacement transducer that electromagnetically interacts with the piston to sense the position of the piston.

22. The system of claim 18, wherein the controller opens the check valve when the sensed position of the piston indicates that the piston is in a retraction cycle.

23. The system of claim 18, wherein the controller closes the check valve when the sensed position of the piston indicates that the piston is in an advance cycle.

* * * * *